US008638973B2

(12) United States Patent
Hayashi et al.

(10) Patent No.: US 8,638,973 B2
(45) Date of Patent: Jan. 28, 2014

(54) SPEAKER APPARATUS

(75) Inventors: Shoichiro Hayashi, Chiyoda-ku (JP); Toshinori Hanji, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/639,252

(22) PCT Filed: Apr. 27, 2010

(86) PCT No.: PCT/JP2010/057484

§ 371 (c)(1), (2), (4) Date: Oct. 4, 2012

(87) PCT Pub. No.: WO2011/135678

PCT Pub. Date: Nov. 3, 2011

(65) Prior Publication Data

US 2013/0028464 A1 Jan. 31, 2013

(51) Int. Cl.
*H04R 25/00* (2006.01)

(52) U.S. Cl.
USPC ..... 381/391; 381/386; 381/189

(58) Field of Classification Search
USPC ..... 381/332, 334, 340, 342, 386, 391, 189; 181/149, 155, 175, 199
See application file for complete search history.

(56) References Cited

U.S. PATENT DOCUMENTS 3,328,869 A 7/1967 Lannert
3,909,530 A * 9/1975 Gosswiller ..... 381/342
3,995,125 A * 11/1976 Cypser ..... 381/391
4,071,111 A 1/1978 Croup
4,719,322 A 1/1988 Guzik et al.
6,128,394 A * 10/2000 Hayakawa et al. ..... 381/386
7,840,021 B2 * 11/2010 Greco et al. ..... 381/334

FOREIGN PATENT DOCUMENTS

JP 58-96384 U 6/1983
JP 7-20695 U 4/1995
JP 07-107579 A 4/1995
JP 08-230573 A 9/1996
JP 09-327082 A 12/1997
JP 11-030494 A 2/1999

OTHER PUBLICATIONS

German Office Action, Jun. 26, 2013, Patent Application No. 11 2010005 525 4.

* cited by examiner

*Primary Examiner* — Huyen D Le
(74) *Attorney, Agent, or Firm* — Sughrue Mion, PLLC

(57) ABSTRACT

A speaker apparatus comprises a slit structure, wherein the slit structure including a plurality of plate-shaped parts each of which extends so that a plurality of slits are formed, a plurality of fold-back parts each of which is folded back from an end of the plate-shaped part on the side of the speaker toward a side of the front surface of the housing, so that the plurality of slits are formed, and a drain part that is arranged on a side of one of the two side surfaces of the housing, and wherein each of a plurality of grooves formed by the plurality of plate-shaped parts and the plurality of fold-back parts communicates with the drain part and is inclined so that, in a posture of the slit structure when the operation panel is operated, liquid led from the plate-shaped parts flows to the drain part.

4 Claims, 4 Drawing Sheets

SPEAKER APPARATUS

CROSS REFERENCE TO RELATED APPLICATIONS

This application is a National Stage of International Application No. PCT/JP2010/057484 filed Apr. 27, 2010, the contents of all of which are incorporated herein by reference in their entirety.

TECHNICAL FIELD

The present invention relates to a speaker apparatus.

BACKGROUND ART

Patent Literature 1 describes an in-vehicle speaker in which through-holes of a speaker cover for causing sound to pass through are formed by a plurality of grille pieces, each of which is configured by a horizontal piece part extending in a horizontal direction and a vertical piece part upright in an inclined manner from a front end of the horizontal piece part toward the front of a vehicle body. With this configuration, according to Patent Literature 1, it is possible to prevent dust and dirt from entering a speaker main body.

CITATION LIST

Patent Literature

Patent Literature 1: Japanese Patent Application Laid-open No. H8-230573

DISCLOSURE OF INVENTION

Problem to be Solved by the Invention

In Patent Literature 1 does not describe a prevention of liquid from entering a speaker main body.

Meanwhile, a speaker for voice guidance is sometimes installed in an operation panel as an auxiliary function at the time of operating a machine tool. In this case, a plurality of openings are required for externally outputting sound of the speaker installed in the operation panel. At this time, the environment in which the machine tool is used is such that cutting oil in a mist form falls on the operation panel, the machine tool is operated by an operator thereof with the cutting oil being put on a hand of the operator, or the cutting oil scattered from a worked layer is directly put on the operation panel. Accordingly, the cutting oil may enter the operation panel from the openings for outputting sound of the speaker. Particularly, the operation panel is often used while being inclined from a vertical direction toward a rear surface side for easiness of operations. Therefore, it is highly possible that cutting oil enters the operation panel from the openings. If cutting oil (liquid) enters the operation panel and adhered on the speaker in the operation panel, the speaker may be corroded and result in malfunctions.

The present invention has been achieved in view of the above problems, and an object of the present invention is to provide a speaker apparatus that can reduce malfunctions of a speaker.

Means for Solving Problem

To solve the problem and to achieve the above object, there is provided a speaker apparatus integrated with an operation panel of a machine tool, the speaker apparatus comprising: a speaker; a housing including a front surface where the operation panel is arranged and a plurality of openings are formed at a position corresponding to the speaker, two side surfaces adjacent to both sides of the front surface, and a bottom surface adjacent to the front surface and the two side surfaces; and a slit structure that is arranged between the speaker and the plurality of openings and is fixed to the housing, wherein the slit structure including a plurality of plate-shaped parts each of which extends in a direction along the bottom surface while being inclined from a side of the speaker toward a side of the bottom surface of the housing, so that a plurality of slits are formed, a plurality of fold-back parts each of which is folded back from an end of the plate-shaped part on the side of the speaker toward a side of the front surface of the housing, so that the plurality of slits are formed, and a drain part that is arranged on a side of one of the two side surfaces of the housing, and wherein each of a plurality of grooves formed by the plurality of plate-shaped parts and the plurality of fold-back parts communicates with the drain part and is inclined so that, in a posture of the slit structure when the operation panel is operated, liquid led from the plate-shaped parts flows to the drain part.

Effect of the Invention

According to the present invention, liquid having passed through openings of a housing and hit plate-shaped parts of a slit structure so as to be led to grooves can flow within the grooves to a drain part and can be discharged to outside from the drain part. As a result, it is possible to suppress overflowing of the liquid from the grooves and entering of the liquid into a speaker, and therefore corrosion of the speaker caused by the liquid adhered on the speaker can be suppressed. Consequently, malfunctions of the speaker can be reduced.

EMBODIMENT(S) FOR CARRYING OUT THE INVENTION

Exemplary embodiments of a speaker apparatus according to the present invention will be explained below in detail with reference to the accompanying drawings. The present invention is not limited to the embodiments.

Embodiment

Figure 1:
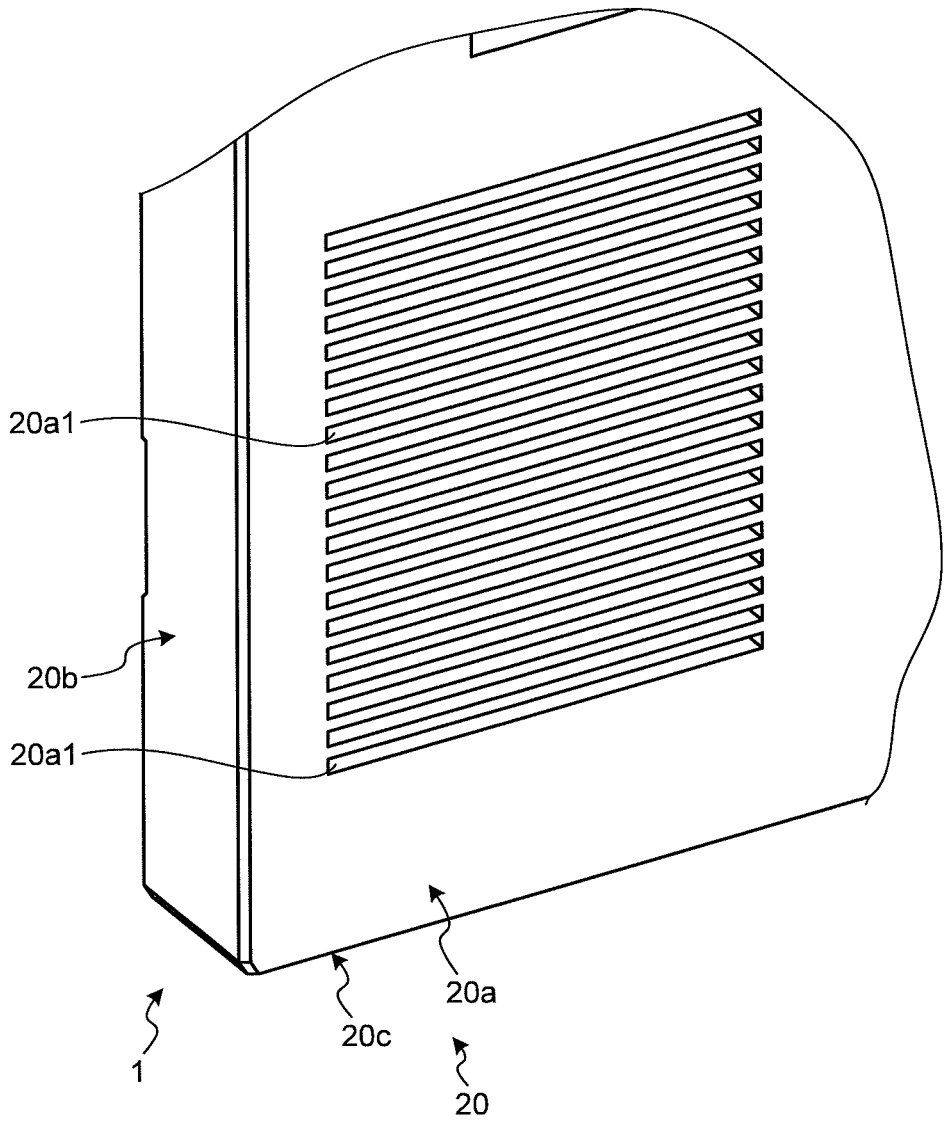
FIG. 1 is a perspective view of an exterior of an external housing according to an embodiment.

An external configuration of a speaker apparatus 1 according to an embodiment of the present invention is explained with reference to FIG. 1. FIG. 1 is a perspective view of an exterior of an external housing 20 according to the present embodiment.

The speaker apparatus 1 is integrated with an operation panel (not shown) of a machine tool. For example, the operation panel is a keyboard or a touch panel. The operation panel is usually used in a state of being inclined from a vertical direction toward a rear surface side so as to form an acute angle for easiness of operations. Correspondingly, because the speaker apparatus 1 is integrated with the operation panel, usually, the speaker apparatus 1 is also used with being inclined from the vertical direction toward the rear surface side so as to form an acute angle θ (0≤θ≤90°−κ, as for κ, see FIG. 4).

As shown in FIG. 1, the speaker apparatus 1 includes the external housing 20 that has a front surface 20*a*, two side surfaces adjacent to both sides of the front surface 20*a* (a side surface 20*b* and a side surface (not shown) opposite to the side surface 20*b*), and a bottom surface 20*c* adjacent to the front surface 20*a* and the two side surfaces. A plurality of openings 20*a*1 for outputting output sound of a speaker 10 (see FIG. 3(*b*)) to a user are formed at a position of the front surface 20*a* corresponding to the speaker 10. The operation panel is also arranged at a position of the front surface 20*a* adjacent to the openings 20*a*1 (for example, on the right side of FIG. 1). Each of the openings 20*a*1 is formed in, for example, a slit shape extending in a direction along the bottom surface 20*c* of the external housing 20 as shown in FIG. 1. The external housing 20 is formed of a resin such as plastic, for example.

Figure 2:
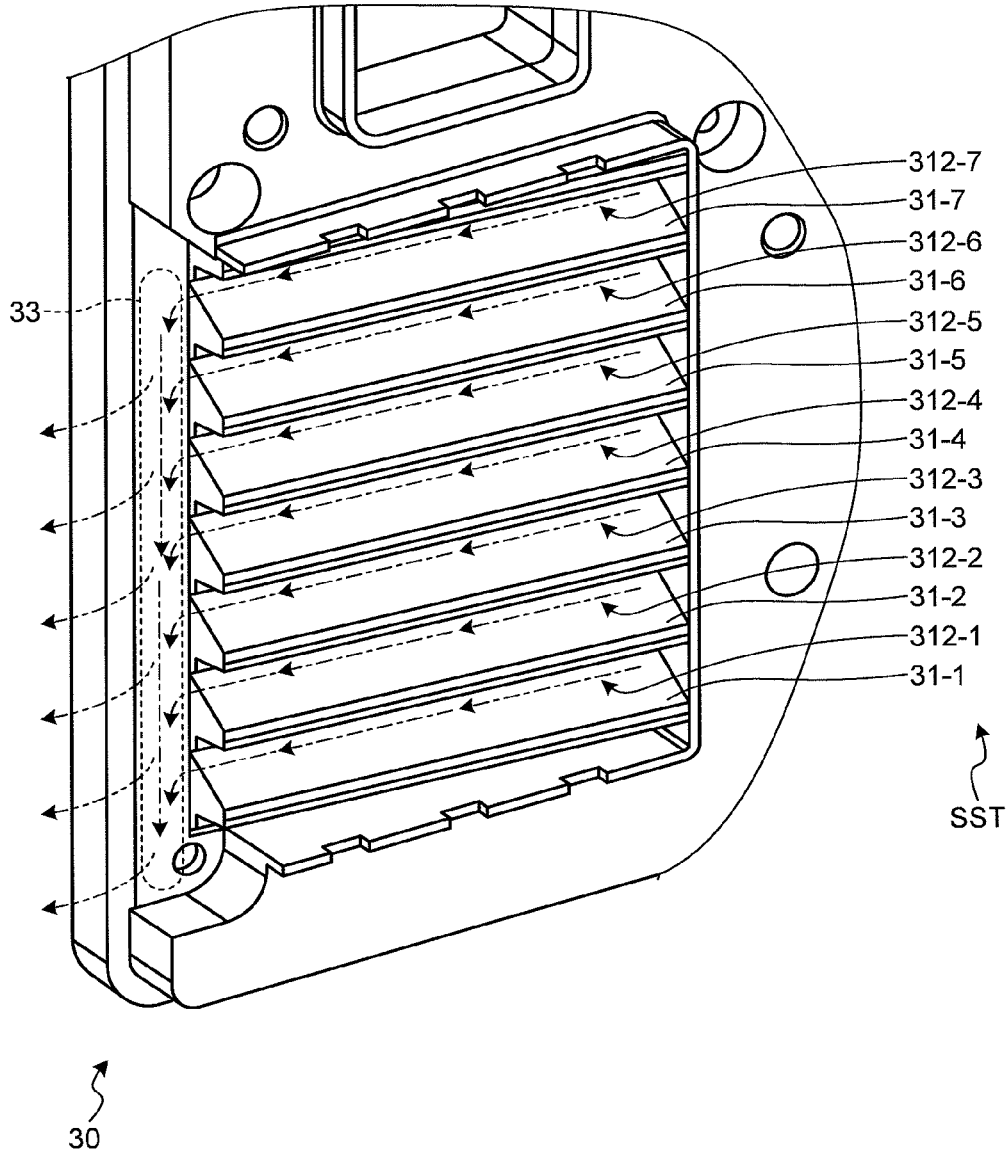
FIG. 2 is a perspective view of an exterior of an internal housing according to the embodiment.
Figure 3A:
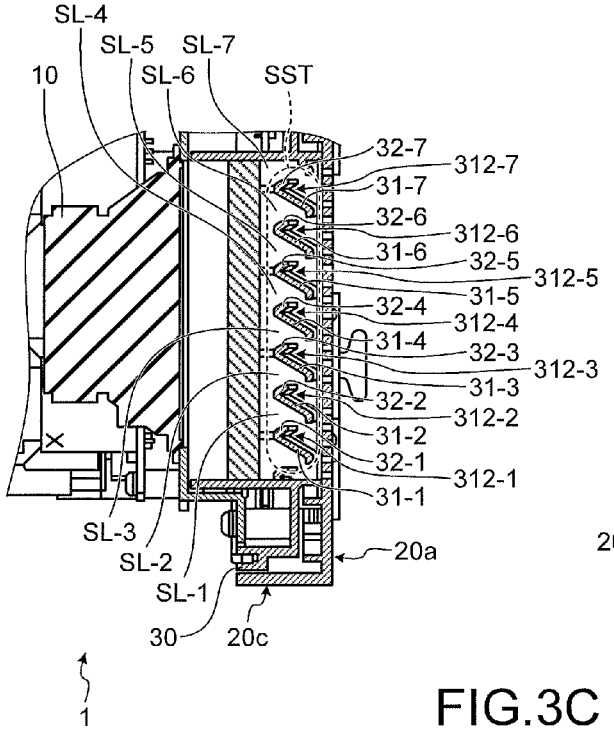
FIGS. 3A to 3C depict a configuration of a speaker apparatus according to the embodiment.
Figure 3B:
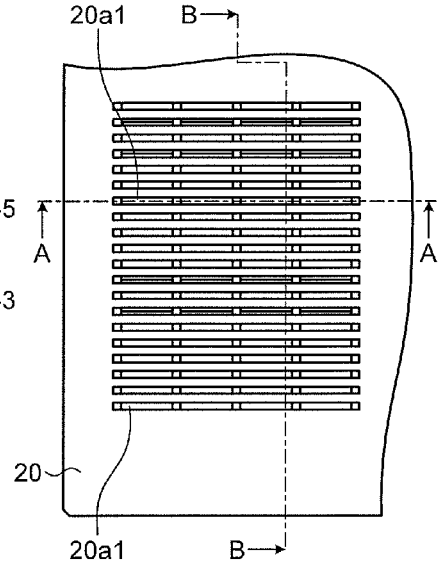
Figure 3C:
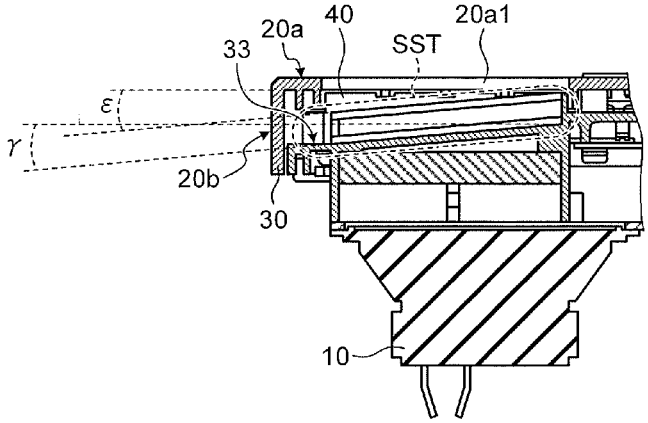
Figure 4:
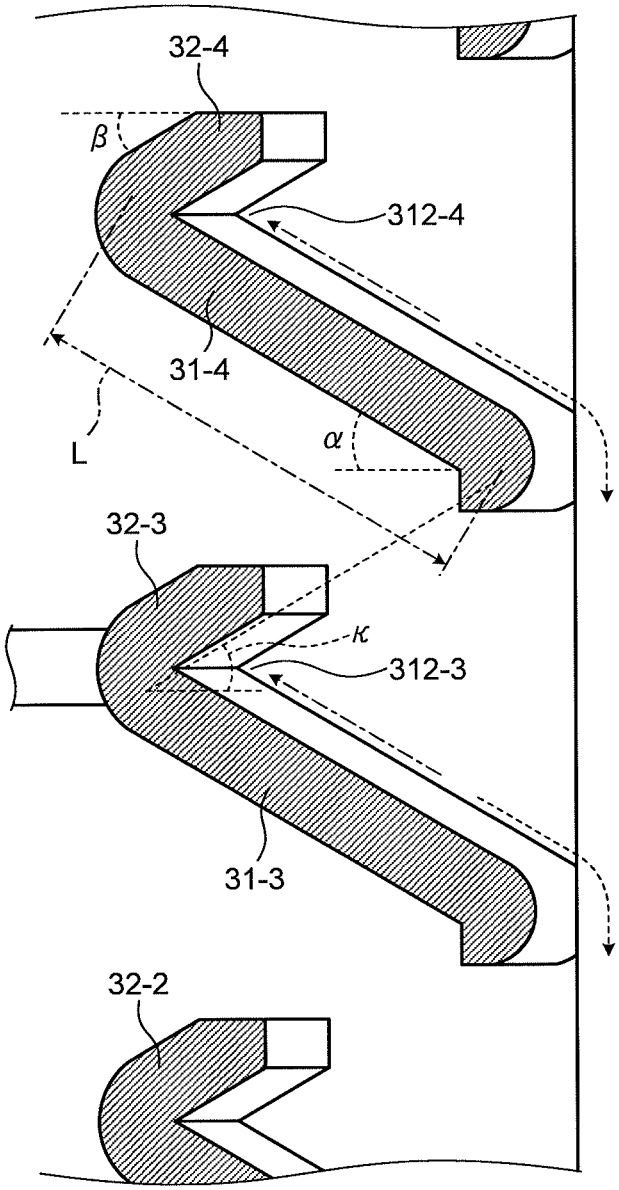
FIG. 4 is an enlarged cross-sectional diagram of a vicinity of a groove according to the embodiment.

Next, a configuration of the speaker apparatus 1 according to the present invention is explained with reference to FIGS. 2 to 4. FIG. 2 is a perspective view of an exterior of an internal housing 30 according to the present embodiment. FIG. 3A is a front view of the speaker apparatus 1. FIG. 3B is a cross-sectional diagram along B-B of FIG. 3A. FIG. 3C is a cross-sectional diagram along A-A of FIG. 3A. FIG. 4 is an enlarged cross-sectional diagram of a vicinity of a groove according to the present embodiment.

As shown in FIG. 3B, the speaker apparatus 1 includes the speaker 10, the external housing 20 (see FIG. 3A), and the internal housing 30.

The speaker 10 outputs sound of voice guidance (guidance information) such as an operation method as an auxiliary function at the time of operating a machine tool according to a predetermined operation of a user via the operation panel or a predetermined operation of the machine tool. A front surface (a voice output surface) side of the speaker 10 is surrounded by the internal housing 30 and the external housing 20. That is, the speaker 10 is surrounded by the external housing 20 and the internal housing 30 so that liquid (such as cutting oil) does not directly enter from outside.

As explained above, the external housing 20 includes the front surface 20*a*, the side surface 20*b* (and a side surface (not shown) opposite to the side surface 20*b*), and the bottom surface 20*c*. An operation panel (not shown) is arranged on the front surface 20*a*. The openings 20*a*1 are also formed at the position of the front surface 20*a* corresponding to the speaker 10. The external housing 20 is fitted on the internal housing 30 so as to cover the internal housing 30.

The internal housing 30 is arranged between the speaker 10 and the external housing 20 so as to surround the voice output surface of the speaker 10 from its periphery. The internal housing 30 is fitted into the speaker 10 and the external housing 20 is fitted into the internal housing 30. The internal housing 30 is fixed to the speaker 10 and to an inner side (a side of the speaker 10) of the external housing 20. The internal housing 30 is formed of a resin such as plastic, for example. The internal housing 30 has a slit structure SST.

The slit structure SST is arranged between the speaker 10 and the external housing 20. The slit structure SST is fixed to the speaker 10 and to the inner side (the side of the speaker 10) of the external housing 20. Because the slit structure SST is fixed to the external housing 20, when the operation panel is used, the slit structure SST is used in a posture inclined from the vertical direction toward the side of the speaker 10 so as to form the acute angle θ (0≤θ≤90°−κ, as for κ, see FIG. 4).

Specifically, the slit structure SST includes a plurality of plate-shaped parts 31-1 to 31-7, a plurality of fold-back parts 32-1 to 32-7, and a drain part 33 (see FIG. 2).

The plate-shaped parts 31-1 to 31-7 extend in the direction along the bottom surface 20*c* of the external housing 20 while being inclined from the side of the speaker 10 toward a side of the bottom surface 20*c* of the external housing 20 so that a plurality of slits SL-1 to SL-7 are formed. Each of the plate-shaped parts 31-1 to 31-7 is inclined from the side of the speaker 10 toward the side of the bottom surface 20*c* so as to form an angle α (see FIG. 4) with a normal line of the front surface 20*a* of the external housing 20. Each of the plate-shaped parts 31-1 to 31-7 has a length L in a cross-section (see FIG. 4) cut in parallel to the side surface 20*b*. The angle α and the length L are set such that, when the operation panel is used, liquid (such as cutting oil) having passed through the openings 20*a*1 hits the plate-shaped parts 31-1 to 31-7. That is, the angle α and the length L are set such that, in a case where the external housing 20 and the slit structure SST are in a posture inclined from the vertical direction toward the speaker 10 side so as to form the acute angle θ (0≤θ≤90°−κ, as for κ, see FIG. 4), as the external housing 20 and the slit structure SST are perspectively viewed from the vertical direction, the plate-shaped parts 31-1 to 31-7 overlap with each other without any space therebetween in an area where the openings 20*a*1 are arranged. For example, the angle α is 30°. The angle κ is an angle formed by a line connecting an end of the speaker 10 side of a plate-shaped part (for example, 31-3) to an end of the front surface 20*a* side of a plate-shaped part (for example, 31-4) adjacent to the plate-shaped part 31-3 in an upper side of FIG. 4 and by the normal line of the front surface 20*a* in the cross-section (see FIG. 4) cut in parallel to the side surface 20*b*.

The fold-back parts 32-1 to 32-7 are folded back from ends of the speaker 10 side of the plate-shaped parts 31-1 to 31-7 toward the side of the front surface 20*a* of the external housing 20 so that the slits SL-1 to SL-7 are formed. Each of the fold-back parts 32-1 to 32-7 is inclined from the side of the speaker 10 toward the side of the front surface 20*a* of the external housing 20 so as to form an angle β (see FIG. 4) with the normal line of the front surface 20*a* of the external housing 20 (on a side opposite to the side that the plate-shaped parts 31-1 to 31-7). The angle β is set such that grooves 312-1 to 312-7 can hold liquid and is set to be 30°, for example.

Positions of the slits SL-1 to SL-7 are adjusted so that, as perspectively viewed from a direction perpendicular to the front surface 20*a*, the slits SL-1 to SL-7 and the openings 20*a*1 overlap with each other in a larger area. With this adjustment, output sound of the speaker 10 is easily output from the openings 20*a*1 via the slits SL-1 to SL-7.

The drain part 33 (see FIG. 2) discharges received liquid to outside and is arranged on the side surface 20*b* side as one of two side surfaces of the external housing 20 for the plate-shaped parts 31-1 to 31-7 and the fold-back parts 32-1 to 32-7. That is, the drain part 33 extends, for example, in the direction along the side surface 20*b* at a position adjacent to ends of the side surface 20*b* side of the plate-shaped parts 31-1 to 31-7 and to the ends of the side surface 20*b* side of the fold-back parts 32-1 to 32-7.

Each of the grooves (for example, cutting-oil collecting grooves) 312-1 to 312-7 formed by the plate-shaped parts 31-1 to 31-7 and the fold-back parts 32-1 to 32-7 (see FIG. 4) communicates with the drain part 33. Each of the grooves 312-1 to 312-7 is inclined so that, in a posture of the slit structure SST at the time of operating the operation panel, liquid (such as cutting oil) led from the plate-shaped parts 31-1 to 31-7 flows to the drain part 33. That is, each of the grooves 312-1 to 312-7 is inclined (for example, three-dimensionally) so that, in the posture of the slit structure SST inclined from the vertical direction toward the side of the speaker 10 so as to form the acute angle θ ($0 \leq \theta \leq 90° - \kappa$, as for κ, see FIG. 4), liquid led from the plate-shaped parts 31-1 to 31-7 flows to the drain part 33.

Specifically, as shown in FIG. 3C, each of the grooves 312-1 to 312-7 is inclined so that a part near the drain part 33 is further away from the front surface 20*a* of the external housing 20 than a part away from the drain part 33. For example, each of the grooves 312-1 to 312-7 is inclined so as to be away from the front surface 20*a* as approaching the drain part 33. For example, as shown in FIG. 3C, each of the grooves 312-1 to 312-7 is inclined so as to form an angle γ with the front surface 20*a* of the external housing 20. The angle γ is set such that, in the posture of the slit structure SST at the time of operating the operation panel, liquid flows within the grooves 312-1 to 312-7 toward the drain part 33 and is set to be 15°, for example.

Furthermore, as shown in FIG. 3C, the end of the front surface 20*a* side of each of the plate-shaped parts 31-1 to 31-7 is inclined so that the part near the drain part 33 is further away from the front surface 20*a* of the external housing 20 than the part away from the drain part 33. For example, the end of the front surface 20*a* side of each of the plate-shaped parts 31-1 to 31-7 is inclined so as to be away from the front surface 20*a* as approaching the drain part 33. For example, the end of the front surface 20*a* side of each of the plate-shaped parts 31-1 to 31-7 is inclined, as shown in FIG. 3C, so as to form an angle ϵ with the front surface 20*a* of the external housing 20. The angle ϵ is set such that the plate-shaped parts 31-1 to 31-7 are easily designed (that is, substantially equal to the angle γ) and is set to be 15°, for example. Because the end of the front surface 20*a* side of the plate-shaped parts 31-1 to 31-7 is inclined, a gap 40 shown in FIG. 3C is formed between the plate-shaped parts 31-1 to 31-7 and the external housing 20.

A case where the respective grooves 312-1 to 312-7 are not inclined is considered here. That is, there is considered a case where the respective grooves 312-1 to 312-7 extend within a surface parallel to the front surface 20*a* of the external housing 20 so as to be in parallel to the bottom surface 20*c* (see FIG. 1) of the external housing 20. In this case, in the posture of the slit structure SST at the time of operating the operation panel, liquid (such as cutting oil) having passed through the openings 20*a*1 of the external housing 20 and hit the plate-shaped parts 31-1 to 31-7 of the slit structure SST so as to be led to the grooves 312-1 to 312-7 tends to remain within the grooves 312-1 to 312-7. The liquid subsequently led to the grooves 312-1 to 312-7 may overflow from the grooves 312-1 to 312-7 to enter the speaker 10. If the liquid is adhered on the speaker 10, the speaker 10 may be corroded and result in malfunctions.

On the other hand, according to the present embodiment, the respective grooves 312-1 to 312-7 communicate with the drain part 33 and are inclined so that, in the posture of the slit structure SST at the time of operating the operation panel, the liquid led from the plate-shaped parts 31-1 to 31-7 flows to the drain part 33. With this configuration, the liquid having passed through the openings 20*a*1 of the external housing 20 and hit the plate-shaped parts 31-1 to 31-7 of the slit structure SST so as to be led to the grooves 312-1 to 312-7 can flow within the grooves 312-1 to 312-7 to the drain part 33 and can be discharged to outside from the drain part 33. Consequently, it is possible to suppress overflowing of the liquid from the grooves 312-1 to 312-7 and entering of the liquid into the speaker 10, and therefore corrosion of the speaker 10 caused by the liquid adhered on the speaker 10 can be suppressed. Consequently, malfunctions of the speaker 10 can be reduced.

Specifically, because the speaker apparatus 1 is integrated with the operation panel, when the operation panel is operated by a user, the speaker apparatus 1 is used in a posture inclined from the vertical direction toward the rear surface side so as to form, for example, the acute angle θ ($0 \leq \theta \leq 90° - \kappa$, as for κ, see FIG. 4). When the inclination angle θ at which the operation panel is used is smaller than α (such as 30°, see FIG. 4), the plate-shaped parts 31-1 to 31-7 are in a posture inclined from the posture shown in FIG. 4 toward the side of the speaker 10 at an angle smaller than α. Accordingly, as shown by a broken line arrow of FIG. 4, the liquid having hit the plate-shaped parts 31-1 to 31-7 can flow toward the side of the front surface 20*a* of the external housing 20 to be discharged to outside via, for example, the gap 40. When the inclination angle θ at which the operation panel is used is equal to or larger than α (such as 30°), the plate-shaped parts 31-1 to 31-7 are in a posture inclined from the posture shown in FIG. 4 toward the side of the speaker 10 at an angle equal to or larger than α. With this configuration, the liquid having hit the plate-shaped parts 31-1 to 31-7 can be led to the grooves 312-1 to 312-7 as shown by a chain line arrow of FIG. 4. The liquid led to the grooves 312-1 to 312-7 can flow within the grooves 312-1 to 312-7 to the drain part 33 to be discharged to outside from the drain part 33 as shown by a two-dot chain line of FIG. 2.

More specifically, as shown in FIG. 2 and FIG. 3C, each of the grooves 312-1 to 312-7 is inclined so that the part near the drain part 33 is further away from the front surface 20*a* (see FIG. 1) of the external housing 20 than the part away from the drain part 33. With this configuration, when the operation panel is used with being inclined from the vertical direction toward the side of the speaker 10 at an angle of about 90°, that is, when the speaker apparatus 1 is in a posture of being substantially horizontal, the liquid led to the grooves 312-1 to 312-7 can easily flow within the grooves 312-1 to 312-7 to the drain part 33 to be discharged to outside from the drain part 33.

Alternatively, there is considered a case where the end of the front surface 20*a* side of each of the plate-shaped parts 31-1 to 31-7 extends so as to contact the inner side of the front surface 20*a* of the external housing 20. In this case, because ends of the front surface 20*a* side of the plate-shaped parts 31-1 to 31-7 block some of the openings 20*a*1, it becomes difficult to lead output sound of the speaker 10 to the openings 20*a*1. In addition, in this case, the three-dimensional configuration of the plate-shaped parts 31-1 to 31-7 becomes complicated and thus it is difficult to design the plate-shaped parts 31-1 to 31-7.

On the other hand, according to the present embodiment, the end of the front surface 20*a* side of each of the plate-shaped parts 31-1 to 31-7 is inclined so that the part near the drain part 33 is further away from the front surface 20*a* of the external housing 20 than the part away from the drain part 33 as shown in FIG. 3C. With this configuration, the gap 40 shown in FIG. 3C can be formed between the plate-shaped parts 31-1 to 31-7 and the external housing 20. Accordingly, it is possible to suppress blocking of the openings 20*a*1 by the plate-shaped parts 31-1 to 31-7 and output sound of the speaker 10 is easily led to the openings 20*a*1. Furthermore, because the three-dimensional configuration of the plate-shaped parts 31-1 to 31-7 can be a simple substantially-rectangular plate shape, the plate-shaped parts 31-1 to 31-7 are easily designed.

Any shape can be used for the openings 20*a*1 as long as it is suitable for outputting output sound of the speaker 10. For example, the openings 20*a*1 can be formed in a slit shape extending in the direction along the side surface 20*b* of the external housing 20.

At least one of a width and an arrangement pitch of the slits SL-1 to SL-6 of the slit structure SST can be identical to, for example, that of the slit-shaped openings 20*a*1 of the external housing 20.

Furthermore, the slit structure SST can be configured so as to handle even a case where the operation panel is used in a horizontal state, that is, the speaker apparatus 1 is in a horizontal posture. In this case, the slit structure SST is configured so that, as perspectively viewed from the direction perpendicular to the front surface 20*a*, the plate-shaped parts 31-1 to 31-7 and the fold-back parts 32-1 to 32-7 adjacent to each other overlap with each other, that is, the arrangement pitch of the plate-shaped parts 31-1 to 31-7 is narrower than that of FIG. 4. That is, a configuration that the configuration shown in FIG. 4 is changed so as to make plate-shaped parts (for example, the plate-shaped parts 31-3 and 31-4) adjacent to each other in top and bottom of FIG. 4 approach so that $\kappa=0°$ is satisfied is provided. At this time, the angle range of the inclination angle at which the operation panel is used explained above is $0 \leq \theta \leq 90°$ by substituting $\kappa=0°$.

INDUSTRIAL APPLICABILITY

As described above, the speaker apparatus according to the present invention is useful as a speaker apparatus that is integrated with an operation panel.

EXPLANATIONS OF LETTERS OR NUMERALS

1 speaker apparatus
10 speaker
20 external housing
20*a* front surface
20*a*1 opening
20*b* side surface
20*c* bottom surface
30 internal housing
31-1 to 31-7 plate-shaped part
32-1 to 32-7 fold-back part
33 drain part
40 gap
312-1 to 312-7 groove
SL-1 to SL-7 slit
SST slit structure

The invention claimed is:

1. A speaker apparatus integrated with an operation panel of a machine tool, the speaker apparatus comprising:

a speaker;

a housing including a front surface where the operation panel is arranged and a plurality of openings are formed at a position corresponding to the speaker, two side surfaces adjacent to both sides of the front surface, and a bottom surface adjacent to the front surface and the two side surfaces; and a slit structure that is arranged between the speaker and the plurality of openings and is fixed to the housing, wherein the slit structure including a plurality of plate-shaped parts each of which extends in a direction along the bottom surface while being inclined from a side of the speaker toward a side of the bottom surface of the housing, so that a plurality of slits are formed, a plurality of fold-back parts each of which is folded back from an end of the plate-shaped part on the side of the speaker toward a side of the front surface of the housing, so that the plurality of slits are formed, and a drain part that is arranged on a side of one of the two side surfaces of the housing, and wherein each of a plurality of grooves formed by the plurality of plate-shaped parts and the plurality of fold-back parts communicates with the drain part and is inclined so that, in a posture of the slit structure when the operation panel is operated, liquid led from the plate-shaped parts flows to the drain part.

2. The speaker apparatus according to claim 1, wherein each of the grooves is inclined so that a part near the drain part is further away from the front surface of the housing than a part away from the drain part.

3. The speaker apparatus according to claim 2, wherein an end of each of the plate-shaped parts on the side of the front surface of the housing is inclined so that a part near the drain part is further away from the front surface of the housing than a part away from the drain part.

4. The speaker apparatus according to claim 1, wherein the slit structure is in an inclined posture from a vertical direction toward the side of the speaker so as to form an acute angle when the operation panel is operated.

* * * * *